US008282501B2

(12) United States Patent
Smith et al.

(10) Patent No.: US 8,282,501 B2
(45) Date of Patent: Oct. 9, 2012

(54) PUTTER-TYPE GOLF CLUB

(75) Inventors: Ashley Smith, Ainsdale (GB); Simon Chan, Liverpool (GB)

(73) Assignee: Seraph Sports Limited, Liverpool (GB)

( * ) Notice: Subject to any disclaimer, the term of this patent is extended or adjusted under 35 U.S.C. 154(b) by 0 days.

(21) Appl. No.: 12/683,985

(22) Filed: Jan. 7, 2010

(65) Prior Publication Data

US 2010/0167831 A1 Jul. 1, 2010

Related U.S. Application Data

(63) Continuation of application No. 11/579,597, filed as application No. PCT/GB2005/001760 on May 9, 2005, now abandoned.

(30) Foreign Application Priority Data

May 7, 2004 (GB) ..... 0410213.3
May 9, 2005 (WO) ..... PCT/GB2005/001760

(51) Int. Cl.
*A63B 69/36* (2006.01)
*A63B 53/04* (2006.01)

(52) U.S. Cl. ..... 473/251; 473/255; 473/305; 473/307; 473/313; 473/334; 473/340; 473/341

(58) Field of Classification Search ..... 473/219–256, 473/305–315, 334–341, 349, 350; D21/736–746
See application file for complete search history.

(56) References Cited

U.S. PATENT DOCUMENTS

| | | | | | |
|---|---|---|---|---|---|
| D204,001 | S * | 3/1966 | Lubin | D21/739 |
| 3,888,492 | A * | 6/1975 | Cabot | 473/255 |
| 4,913,438 | A * | 4/1990 | Anderson | 473/253 |
| 5,046,740 | A * | 9/1991 | D'Eath | 473/255 |
| 5,072,941 | A * | 12/1991 | Klein | 473/255 |
| 5,476,262 | A * | 12/1995 | Bandiero | 473/409 |
| 5,494,282 | A * | 2/1996 | Pranio | 473/313 |
| 6,827,655 | B2 * | 12/2004 | Burns | 473/236 |
| 6,863,617 | B2 * | 3/2005 | Park | 473/226 |
| D507,613 | S * | 7/2005 | Baiocchi | D21/742 |
| 7,004,849 | B2 * | 2/2006 | Cameron | 473/249 |
| 7,297,073 | B2 * | 11/2007 | Jung | 473/340 |
| 7,387,580 | B2 * | 6/2008 | Hasegawa | 473/340 |
| 7,393,285 | B2 * | 7/2008 | Stellander | 473/251 |
| 7,419,439 | B1 * | 9/2008 | Aleamoni | 473/251 |
| 2005/0187028 | A1 * | 8/2005 | Chang et al. | 473/231 |
| 2005/0192114 | A1 * | 9/2005 | Zider et al. | 473/251 |
| 2009/0215547 | A1 * | 8/2009 | Hegarty | 473/219 |

* cited by examiner

*Primary Examiner* — Sebastiano Passaniti

(57) ABSTRACT

A putter-type golf club comprising an alignment system and a club head assembly. The putter-type club head has a body that is preferably composed of aluminum, with a rear weight disk and small inserts composed of a material denser than the material used for the remainder of the club head (excluding the neck of the club). The body has an alignment channel that is approximately the same width as a standard golf ball, and which runs from the face to the rear of the club head. In a preferred embodiment this alignment channel is black or dark in color with a white or light-colored border. The putter-type club has a neck that is inserted laterally through the side of the club head, such that it runs parallel to the face of the club head and for substantially the length of the face.

18 Claims, 3 Drawing Sheets

PUTTER-TYPE GOLF CLUB

CROSS-REFERENCE TO RELATED APPLICATION

This application is a continuation of prior U.S. patent application Ser. No. 11/579,597, filed Sep. 18, 2007 now abandoned, which is a U.S. national phase application under 35 U.S.C. .sctn.371 of PCT Application No. PCT/GB05/001760, filed May 9, 2005, which is an international application of United Kingdom Application No. 0410213.3, filed May 7, 2004. The entireties of these applications are incorporated herein by reference.

BACKGROUND

The present invention relates to a putter-type golf club. More specifically, the present invention relates to a putter-type golf club that embodies a means of alignment to aid the golfer in judging direction when making a putting stroke in combination with a method of insertion of the neck of the golf club into the head of the golf club to further assist the golfer in judging the length and pace of the putting stroke.

SUMMARY

One aspect of the present invention is a putter-type golf club head with a deep alignment channel. This channel is approximately the same width as a standard golf ball, and, according to a preferred embodiment, this channel is black or dark in color so as to contrast with the white or light color of the golf ball and with a border on its perimeter. The depth of the alignment channel, running from the face to the rear of the club head, should preferably be of sufficient length to create a visual impression to the golfer of the ball being 'scooped' in between the white or light-colored border into the back of the illusory channel/cavity. This will provide the golfer with unique assistance in terms of aligning the putter to the target at address, stroke and follow-through, and also in judging the strength required in the stroke action.

The alignment channel has a white or light-colored border on its perimeter, save for where the alignment channel abuts the face of the putter head. This is to visually create an illusory ball 'scoop' catchment area. The alignment channel and border may contrast by color, tone, relief, texture, finish or a combination of the above.

Another aspect of the present invention is the interaction of the neck of the putter with the head of the putter. The neck of the putter-type golf club is the interaction between the shaft of the club and the head of the club. It is normal for the neck to connect with the head of a putter-type club vertically on to the top of the head. In the present invention, the neck is inserted laterally through the side of the head of the putter, such that it runs parallel to the face of the putter head and for substantially the length of the putter head. The neck then connects at its other end with the shaft of the club.

This method of connection of the neck to the club head and shaft will provide the golfer with direct feedback upon contact with the golf ball through the face of the club head, to the neck, the shaft and then to the grip at the top of the shaft and to the golfer's hands. This will improve significantly the golfer's ability, over the traditional method of connection of the neck to the club head, to gauge the distance and pace of the golf shot.

In making golf shots, and this is particularly true of putting shots, the golfer is interested in attaining the optimum "feel" from the golf club. "Feel" is based on a combination of factors, but generally the better the "feel", the more likely the golfer's ability to judge direction and distance in his/her shot. The present invention optimizes "feel" by combining its unique alignment channel, with the unique neck insertion into the putter head, and with a number of other factors. These factors include the putter head being manufactured from aluminum. Aluminum is a softer material than, for example, stainless steel, which, in a preferred embodiment, is the material from which the shaft and neck are manufactured. The result of this combination of materials is that "feel" or "feedback" is better transmitted to the golfer's hands rather than it being dispersed evenly throughout the club head as is the case if only one material is used.

Another factor embodied in the present invention that helps to optimize "feel" is the insertion of a rear weight disk into the putter head. In a preferred embodiment, the rear weight disk is manufactured from nickel, or from any other material that is denser than aluminum, which serves to balance the aluminum putter head with a near 50/50 front/rear weight distribution. Small nickel inserts are also added to the "arms" or "wings" to minimize the torque effects of off-center hits, and to improve the stability and balance of the putter head. The present invention also incorporates through-holes that run parallel to the face of the putter head and are located between the neck insertion and the rear disk insertion. In a preferred embodiment there are three through-holes, equidistant and on the same horizontal axis. These are to further emphasize the weighting towards the front and rear extremes, to afford so-called "forgiveness".

When these factors are combined the weight of the putter head is concentrated in a long line along the alignment channel, and thereby along the axis of the putting stroke path. This can be contrasted with a more laterally weighted traditional "blade" putter head which is more disposed to allowing lateral movement during the stroke, thereby increasing the chances of a 'mis-cued' shot.

A further feature of the present invention is that the face of the putter head is lowered at the lateral ends of the face to create stepped "arms" or "wings". This result is to expose the central alignment portion such that it is raised relative to the lateral ends of the face of the putter head. This exposed, relatively narrow portion of the face forces the golfer to concentrate on ensuring this portion makes contact with the golf ball, and thus encourages the golfer to keep his/her head down throughout the complete stroke.

The present invention can be assembled for a right-handed or left-handed golfer without any further mirrored parts, by simply inserting the neck in the relevant lateral end of the club head.

BRIEF DESCRIPTION OF THE DRAWINGS

The features of the invention will be apparent from the attached drawings and descriptions of a preferred embodiment.

DETAILED DESCRIPTION OF THE DRAWINGS

Figure 1:
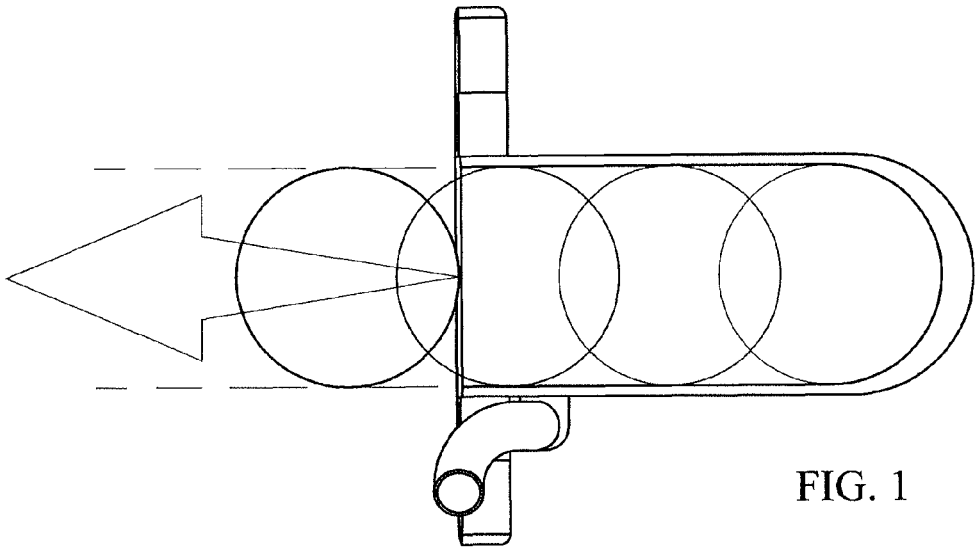
FIG. 1 is a top plan view of a putter head used on a right-handed golf putter embodying the invention, illustrating the illusory 'cavity' effect of the alignment channel and its contrasting border, during a golf stroke.

This embodiment provides for a putter-type golf club, and more particularly for a means of alignment situated on the crown of the head of the putter 1 and a means of insertion of the neck of the putter 2 into the head of the putter 1.

In this embodiment an alignment channel 3 is black or dark in color with a white or light colored border 4 on the perimeter of the alignment channel save for where the alignment channel 3 abuts the face 5 of the head 1. This is so that there are no visual 'interruptions' or barriers destroying the illusion of an opening at the face 5 into the alignment channel 3.

Figure 2:
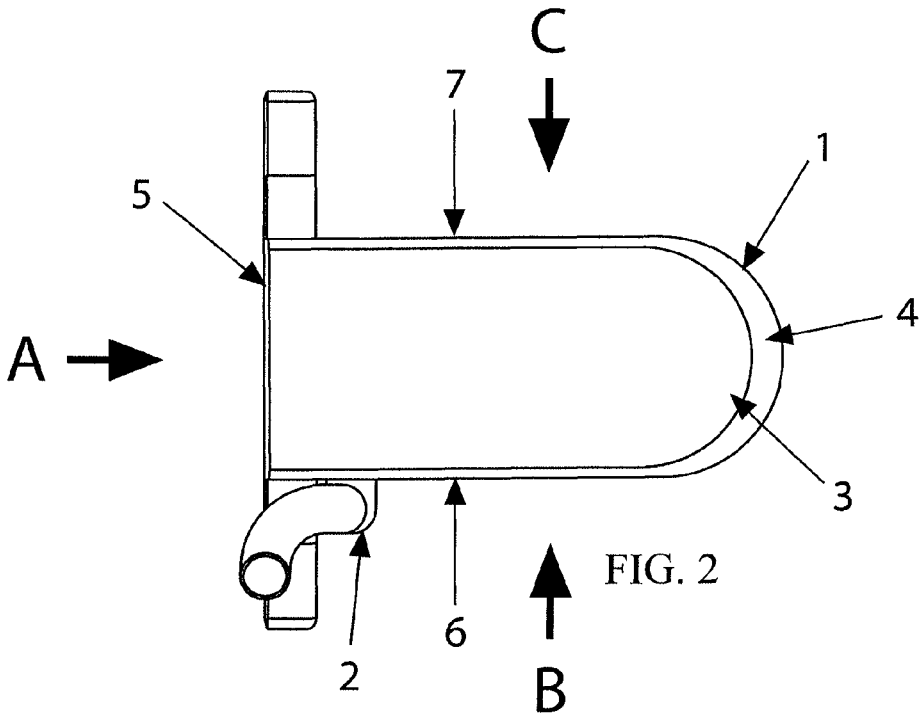
FIG. 2 is a top plan view of a putter head used on a right-handed golf putter embodying the invention.
Figure 3:
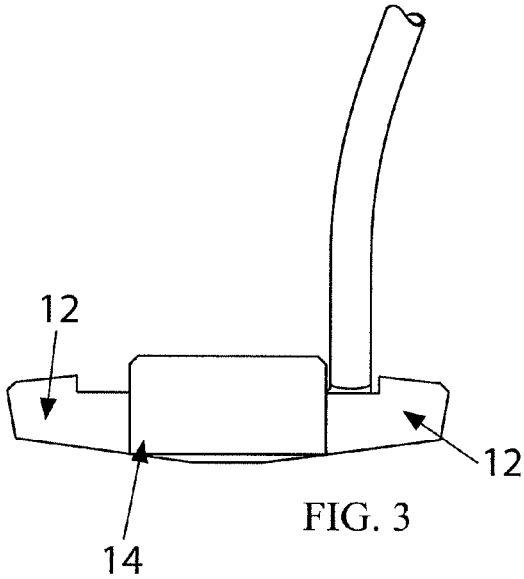
FIG. 3 is a front elevational view of the golf putter in FIG. 2 taken from the direction of arrow A in FIG. 2.

The neck of the putter 2 is inserted into the head 1 laterally behind and parallel to the face 5. In a right-handed embodiment of the putter (i.e. for a right-handed golfer) the neck 2 is inserted at the lateral side of the head (marked 6 in FIG. 2). The neck 2 extends parallel to the face 5 for substantially the width of the alignment channel 3 and its border 4 such that it is flush with the lateral side of the head (marked 7 in FIG. 2). The communication of the neck 2 with the lateral side 7 is illustrated as point 8 in FIG. 7.

Figure 7:
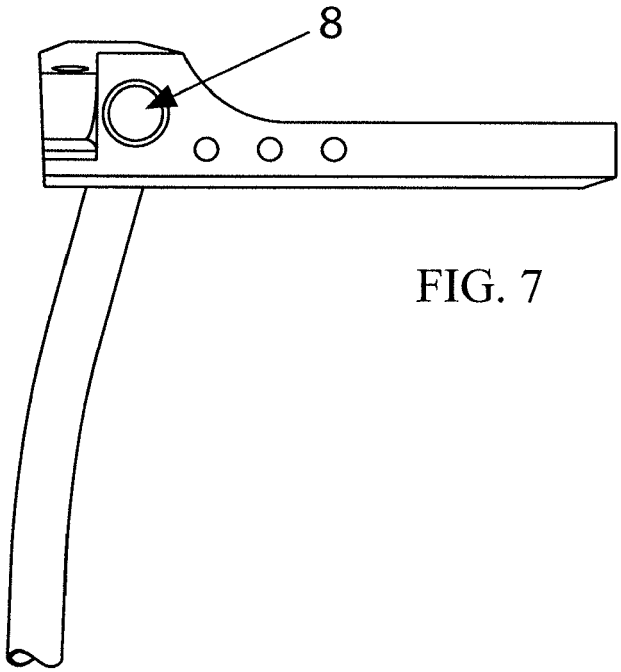
FIG. 7 is a side elevational view of the golf putter in FIG. 2 taken from the direction of arrow C in FIG. 2.

In a left-handed embodiment of the putter (i.e. for a left-handed golfer) the neck 2 is inserted at lateral side 7 and extends parallel to the face 5 such that it communicates with lateral side 6 in a manner illustrated by point 8 in FIG. 7.

Figure 4:
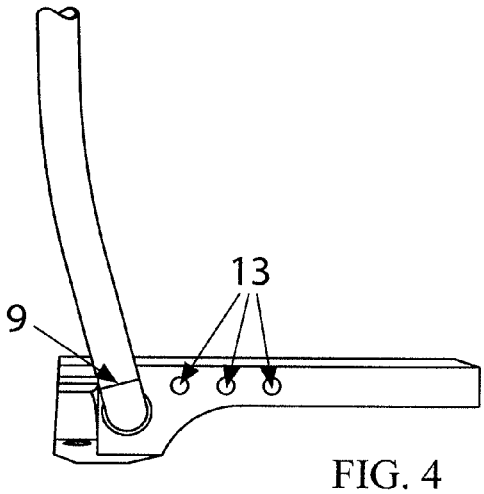
FIG. 4 is a side elevational view of the golf putter in FIG. 2 taken from the direction of arrow B in FIG. 2.
Figure 5:
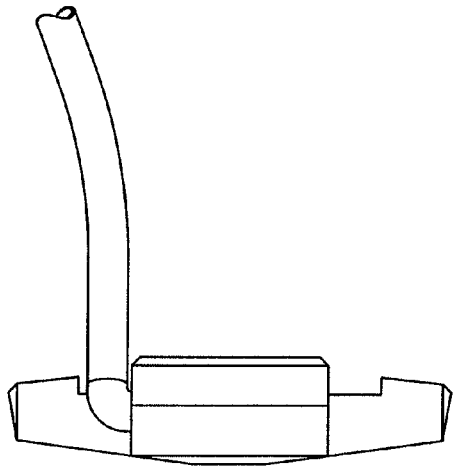
FIG. 5 is a rear elevational view of the golf putter in FIG. 2.

The neck 2 connects to the shaft of the club at point 9 in FIG. 4.

In this preferred embodiment the putter head 1 is manufactured from a material such as aluminum which is softer than, for example, stainless steel, which is the material from which the neck 2 and shaft of the club are both made. There is also a rear weight disk 10 inserted into the putter head 1. This can be inserted via a slip-fit and retained using an adhesive, as it is with this preferred embodiment. This rear weight disk 10 is manufactured from nickel, or from any other material that is denser than aluminum. Small nickel inserts 11, or those made from any other material that is denser than aluminum, are also added to the "arms" or "wings" 12 of the putter head. These can also be inserted and retained in a manner similar to with rear disk weight 10.

The head 1 may also incorporate through-holes 13 that run parallel to the face 5 of the putter head 1. These can be of any diameter, spacing and number. In this preferred embodiment, the through-holes 13 are located between the point at which the neck 2 is inserted and the location of the rear weight disk 10. The through-holes 13 should all be on the same horizontal axis.

The preferred embodiment also incorporates "arms" or "wings" 12 at the lateral ends of the face 5. This exposes the central alignment portion 14 which is approximately the width of a standard golf ball and which is now raised relative to the two ends of the face 5 via substantially right-angled 'steps' in relation to the "arms" or "wings" 12. The height difference between the central alignment portion 14 measured from the crown of the putter head 1 vertically along the edge towards an "arm" or "wing" 12 to the horizontal plane of the 'step' shall be greater than three millimeters. These 'steps' can be either negative with the "arms" or "wings" 12 positioned higher than the central alignment portion 14, or positive with the central alignment portion 14 positioned higher than the "arms" or "wings" 12, as with this preferred embodiment.

Figure 6:
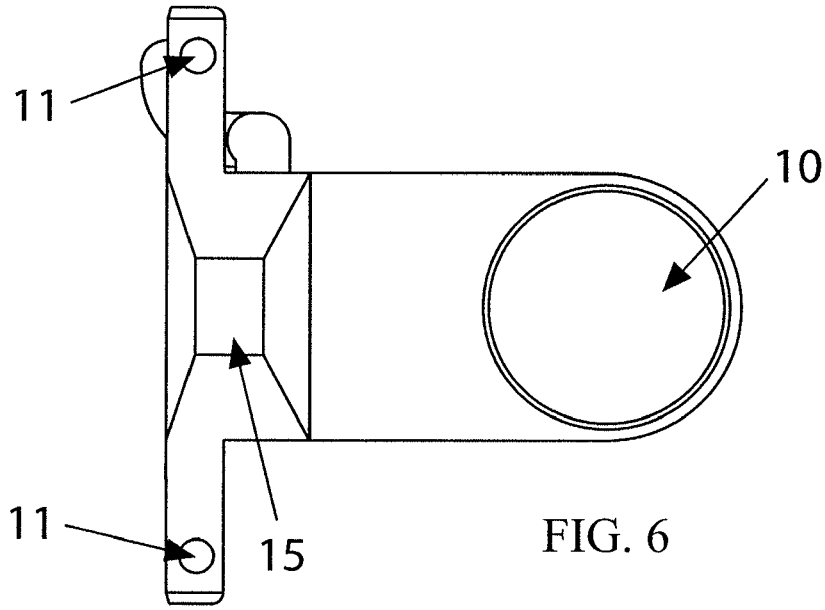
FIG. 6 is a bottom plan view of the golf putter in FIG. 2.

FIG. 6 illustrates the underside of the putter head 1. The chamfers extending from the face 5 and from the opposite edge leading to form a small rectangle or square 15 which is the part of the putter head 1 that rests on the ground reduce 'scuffing' or the catching of the putter head 1 with the ground when the golfer is making his/her stroke. The rear weight disk 10 ensures a near 50/50 front/rear weight distribution such that the head is balanced in the horizontal axis when pivoted at the center of the putter head 1 when excluding a shaft.

What is claimed is:

1. A head for a golf putter comprising an alignment means that visually creates an illusory ball scoop catchment area, disposed on a crown of the head visible to a golfer in use for creating the illusion, in use, of scooping a ball to be struck into the back of a channel when the golfer makes a stroke, the alignment means comprising:

an illusory channel:
- meeting a striking face of the club head;
- being substantially the same width as a golf ball to be struck;

a border:
- with a discernible thickness;
- wherein substantially the whole thickness of the border is any one or more of a contrasting color, tone, relief, texture or finish to substantially the whole width of the illusory channel;
- said border abutting:
  - on at least part of a heel side of the channel;
  - on at least part of a toe side of the channel;
  - on at least part of a rear side of the channel opposite a striking face side of the channel; and
  - not on the striking face side of the channel.

2. A head for a golf putter according to claim 1, further comprising a means for receiving a club neck laterally through a side of the head.

3. A head for a golf putter according to claim 2, wherein the means for receiving comprises an aperture whose longitudinal axis lies substantially parallel to the striking face of the club head.

4. A head for a golf putter according to claim 3, wherein the aperture extends for substantially the length of the club head where the aperture intersects the club head.

5. A head for a golf putter according to claim 2, further comprising a rear weight disk insertable into the club head; further comprising one or more through-holes; and wherein said one or more through-holes is located on the club head between the means for receiving a neck and the rear weight disk.

6. A head for a golf putter according to claim 1, wherein the striking face of the club head comprises a portion of reduced vertical height with respect to a top plane of the club head when said club head is resting on a horizontal surface, extending outwardly on either side of the channel.

7. A head for a golf putter according to claim 1, wherein the striking face of the club head comprises a portion of raised vertical height with respect to a top plane of the club head when said club head is resting on a horizontal surface, extending outwardly on either side of the channel.

8. A head for a golf putter according to claim 1, further comprising one or more counterweights.

9. A head for a golf putter according to claim 7, wherein the one or more counterweights is manufactured of a material of greater density than that of the remainder of the head.

10. A head for a golf putter according to claim 8, wherein the one or more counterweights comprises a rear weight disk insertable into the club head to produce a near 50/50 front/rear weight distribution between the striking face and a rear of the club head opposite the striking face.

11. A head for a golf putter according to claim 8, wherein the one or more counterweights is affixable to the club head near to the striking face thereof.

12. A head for a golf putter according to claim 8, wherein the one or more counterweights is manufactured of a material that is less dense than that of the remainder of the head.

13. A head for a golf putter according to claim 8, further comprising a shaft; and wherein a main club head part of the club can, subject to changing the weight of the one or more counterweights, be used to assemble a club irrespective of the length of said shaft affixed.

14. A head for a golf putter according to claim 1, further comprising one or more through-holes.

15. A head for a golf putter according to claim 14, wherein the longitudinal axis of the one or more though-holes lies substantially parallel to the striking face of the club head.

16. A head for a golf putter according to claim 14, wherein the through-holes are more than one; and wherein each through-hole includes a centerline and the centerlines are equidistant one from the other.

17. A head for a golf putter according to claim 14, wherein the through-holes are more than one; and wherein each through-hole includes a centerline and the centerlines lie on the same plane as each other.

18. A head for a golf putter according to claim 1, further comprising a neck received laterally through a side of the head; and wherein the club can be assembled for a right-handed golfer or a left-handed golfer without the need for a mirrored neck part or a mirrored main club head part, by inserting said neck in the relevant lateral side of the club head.

* * * * *

UNITED STATES PATENT AND TRADEMARK OFFICE

CERTIFICATE OF CORRECTION

PATENT NO. : 8,282,501 B2
APPLICATION NO. : 12/683985
DATED : October 9, 2012
INVENTOR(S) : Ashley Smith and Simon Chan It is certified that error appears in the above-identified patent and that said Letters Patent is hereby corrected as shown below:

Claim 9 in column 4, line 60, should accord to claim --8-- instead of claim "7".

Signed and Sealed this
Eighteenth Day of December, 2012

David J. Kappos

David J. Kappos
*Director of the United States Patent and Trademark Office*